US012780464B2

(12) United States Patent
Otxoa-Aizpurua Calvo

(10) Patent No.: US 12,780,464 B2
(45) Date of Patent: Nov. 3, 2026

(54) VERTICAL PACKAGING MACHINE AND METHOD THEREOF

(71) Applicant: ULMA Packaging, S.Coop., Oñati (ES)

(72) Inventor: Alberto Otxoa-Aizpurua Calvo, Oñati (ES)

(73) Assignee: ULMA Packaging, S.Coop., Oñati (ES)

( * ) Notice: Subject to any disclaimer, the term of this patent is extended or adjusted under 35 U.S.C. 154(b) by 56 days.

(21) Appl. No.: 18/905,469

(22) Filed: Oct. 3, 2024

(65) Prior Publication Data

US 2025/0115383 A1 Apr. 10, 2025

(30) Foreign Application Priority Data

Oct. 4, 2023 (EP) ..... 23383023

(51) Int. Cl.
*B65B 9/20* (2012.01)
*B65B 51/30* (2006.01)

(52) U.S. Cl.
CPC ..... *B65B 9/2007* (2013.01); *B65B 51/303* (2013.01)

(58) Field of Classification Search
CPC ..... B65B 9/2007; B65B 9/2028; B65B 9/213; B65B 51/303
See application file for complete search history.

(56) References Cited

U.S. PATENT DOCUMENTS 3,027,695 A * 4/1962 Leasure ..... B65B 51/303 53/552
4,015,021 A * 3/1977 Harima ..... B65B 25/068 53/436
4,757,668 A * 7/1988 Klinkel ..... B65B 51/32 53/374.6
4,964,259 A * 10/1990 Ylvisaker ..... B65B 9/213 53/511

(Continued)

FOREIGN PATENT DOCUMENTS

DE 10342354 A1 4/2005
EP 0276628 A1 8/1988

(Continued)

OTHER PUBLICATIONS

European Search Report, Application No. 23383023.1, May 15, 2024, 10 pages.

*Primary Examiner* — Andrew M Tecco
(74) *Attorney, Agent, or Firm* — Edell, Shapiro & Finnan, LLC

(57) ABSTRACT

Disclosed is a packaging machine that includes a forming tube with an outlet with a given width in a horizontal direction. The machine also includes a transverse actuation assembly downstream of the forming tube, and a compacting assembly downstream of the transverse actuation assembly that is configured to compact the product to be packaged. Means for extracting gas from the film tube is also provided along with a distribution assembly for modifying the distribution of the product. The distribution assembly is down- (Continued)

stream of the forming tube and includes a first element and a second element facing each other in the horizontal direction and separated from each other by a separation distance smaller than the width of the outlet of the forming tube.

12 Claims, 8 Drawing Sheets

(56) References Cited

U.S. PATENT DOCUMENTS 5,054,270 A * 10/1991 McMahon ..... B29C 66/81435 53/552
5,170,609 A * 12/1992 Bullock ..... B29C 66/1122 53/511
5,241,804 A * 9/1993 Tsuruta ..... B65B 9/213 53/526
6,145,282 A * 11/2000 Tsuruta ..... B65B 9/20 53/551
6,212,861 B1 * 4/2001 Tsuruta ..... B29C 66/004 53/374.6
6,254,911 B1 * 7/2001 Komatsu ..... B65B 1/28 53/436
7,716,901 B2 * 5/2010 Price ..... B65B 61/14 53/469
7,963,090 B2 * 6/2011 Ours ..... B65B 9/213 53/433
8,322,117 B2 * 12/2012 Ours ..... B65B 51/303 53/526
8,631,633 B2 * 1/2014 Monti ..... B29C 66/0326 53/554
2009/0288370 A1 * 11/2009 Ours ..... B65B 1/28 53/512
2011/0209444 A1 * 9/2011 Ours ..... B65B 1/28 53/432

FOREIGN PATENT DOCUMENTS

EP 0518237 B1 9/1996
EP 1184155 B1 9/2003
EP 3599452 A1 1/2020
WO 2009143303 A1 11/2009

* cited by examiner

VERTICAL PACKAGING MACHINE AND METHOD THEREOF

CROSS-REFERENCE TO RELATED APPLICATIONS

This application claims the benefit and priority to European Application No. EP23383023.1, filed Oct. 4, 2023, which is incorporated by reference herein in its entirety.

TECHNICAL FIELD

The present invention relates to a vertical packaging machine and to a method thereof.

BACKGROUND

A vertical packaging machine comprises a hollow forming tube with a longitudinal axis, an inlet and an outlet downstream of the inlet. The longitudinal axis may be vertical or may be inclined with respect to the vertical.

The forming tube is configured to receive a continuous film on the outside and give it a tubular shape, and to receive the products to be packaged through the inlet. These products pass through the inside of the forming tube and go out of the forming tube through the outlet.

In EP3599452A1 a vertical packaging machine is disclosed, with a forming tube as described. The machine further comprises a longitudinal sealing assembly for longitudinally sealing the longitudinal edges of the tubular shaped film surrounding the forming tube, thereby generating a film tube, and a transverse actuation assembly downstream of the forming tube, for cutting the film tube transversely with respect to the longitudinal axis of the forming tube and for sealing said film tube on both sides of the cut, when said transverse actuation assembly is arranged in a closed position. The operation of the transverse actuation assembly results in a film tube closed at one end upstream of the cut, and a package closed at both ends downstream of the cut. The product delivered through the forming tube reaches the closed end of the film tube and will form part of the package generated as a result of the next actuation of the transverse actuation assembly.

SUMMARY

Disclosed is a vertical packaging machine and an associated method.

A first aspect of the invention relates to a packaging machine comprising a forming tube which is configured to give a tubular shape to a film and which comprises an outlet with a given outlet width in a given horizontal direction; a longitudinal sealing assembly configured to longitudinally seal together two facing ends of the tubular shaped film and to generate a film tube with said longitudinal seal; driving means for advancing the film tube; and a transverse actuation assembly which is arranged downstream of the forming tube and comprises two opposing actuation tools configured to move in the horizontal direction between a first position in which they allow the film tube to pass through and a second position in which they clamp the film tube together.

The machine further comprises a compacting assembly downstream of the transverse actuation assembly and configured to compact the product once the product is inside the film tube and has passed through the actuation tools. This allows the product to be distributed in such a way that more compact packs can be obtained.

The machine also includes extraction means configured to extract a gas from the film tube, in such a way that once the compacting assembly has acted on the product and the pack has been generated, the product cannot return to its original position (position before being compacted) due to this extraction. This is especially evident in products with a certain rigidity, such as frozen products (for example French fries).

The machine further comprises a distribution assembly configured to, in use, modify the distribution of the product inside the film tube downstream of the forming tube by acting outside the film tube. The distribution assembly comprises a first distribution element and a second distribution element facing each other in the horizontal direction and spaced apart from each other in that horizontal direction by a separation distance smaller than the outlet width of the outlet of the forming tube, said separation distance being such that it allows the passage of the film tube and the product to be packaged between said first distribution element and said second distribution element. As said separation distance is smaller than said outlet width, said distribution elements act against the film tube passing through them and against the supplied product when said product reaches the height of the distribution assembly during its fall, the distribution of said product inside the film tube being modified as a result of said contact. The separation distance can be adjusted depending on the product to be packaged, for example, but, in any case, allowing the product to pass between the two distribution elements of the distribution assembly.

The change of distribution makes it possible to lengthen the arrangement of the product inside the film tube, preventing it from balling up (or at least reducing the risk). Such balling can lead to jamming or can limit the subsequent storage of the packages thus generated, aspects which are prevented by the proposed machine.

At least the first distribution element is a rotatory element and is arranged in such a way that the film tube rests against the rotatory element. Being a rotatory element, the rotatory element can rotate at the same speed as the advancing film tube, following the movement of the film tube while pressing on the product advancing inside the film tube, thus reducing the risk of jamming the product and damaging the film tube during its action on the film tube.

In the context of the invention, a rotatory element is to be understood as an element which rotates around an axle, the axle being its central axis, such as a wheel or a roller.

In this way, the actions on the product during its packaging allows the product to be arranged more homogeneously inside the final packaging, and thus can give the final packaging a more homogeneous shape. Once the packs have been generated, a certain number of packs are usually placed in a box for transport, and the homogeneous way in which the machine of the invention distributes the product inside the pack allows more packs to be placed in the same box.

A second aspect of the invention relates to a method for a vertical packaging machine such as the one of the first aspect of the invention, in any of its configurations and/or embodiments.

The method comprises arranging a film around a forming tube comprising an outlet with a given outlet width in a given horizontal direction; sealing together two longitudinal ends of the film arranged around the forming tube by means of a longitudinal sealing assembly, a film tube being generated; causing the film tube to advance with driving means;

and supplying a product to be packaged into the film tube, through the inside of the forming tube.

The method further comprises compacting the product disposed inside the film tube downstream of the transverse actuation assembly with a compacting assembly, and extracting a gas from the film tube with extraction means at least after compacting the product, to decrease the volume of the final package generated; and transverse sealing and cutting said film tube downstream of the forming tube with a transverse actuation assembly, to generate a package with a packaged product therein.

In the method, in addition, before the product is compacted with the compacting assembly, part of the film tube between the forming tube and the transverse sealing assembly is pressed inwards, from the outside, with a first distribution element and a second distribution element of a distribution assembly, between which the film tube passes, in order to change the distribution of the product passing through these distribution elements inside the film tube. These distribution elements face each other in the horizontal direction and are spaced apart in the horizontal direction by a separation distance smaller than the outlet width of the outlet of the forming tube (but which allows the passage of the film tube and the product). By pressing said part of the tube inwards, the cross-section of the inside of said film tube at said point is reduced and the product is acted upon as it passes through said point. At least the first distribution element is a rotatory element, which at least helps the product and the film tube to continue to move forward despite the respective actuation and pressure. The advantages described for the machine also apply to the method.

These and other advantages and features of the invention will become apparent in view of the figures and the detailed description.

DETAILED DESCRIPTION

Figure 1:
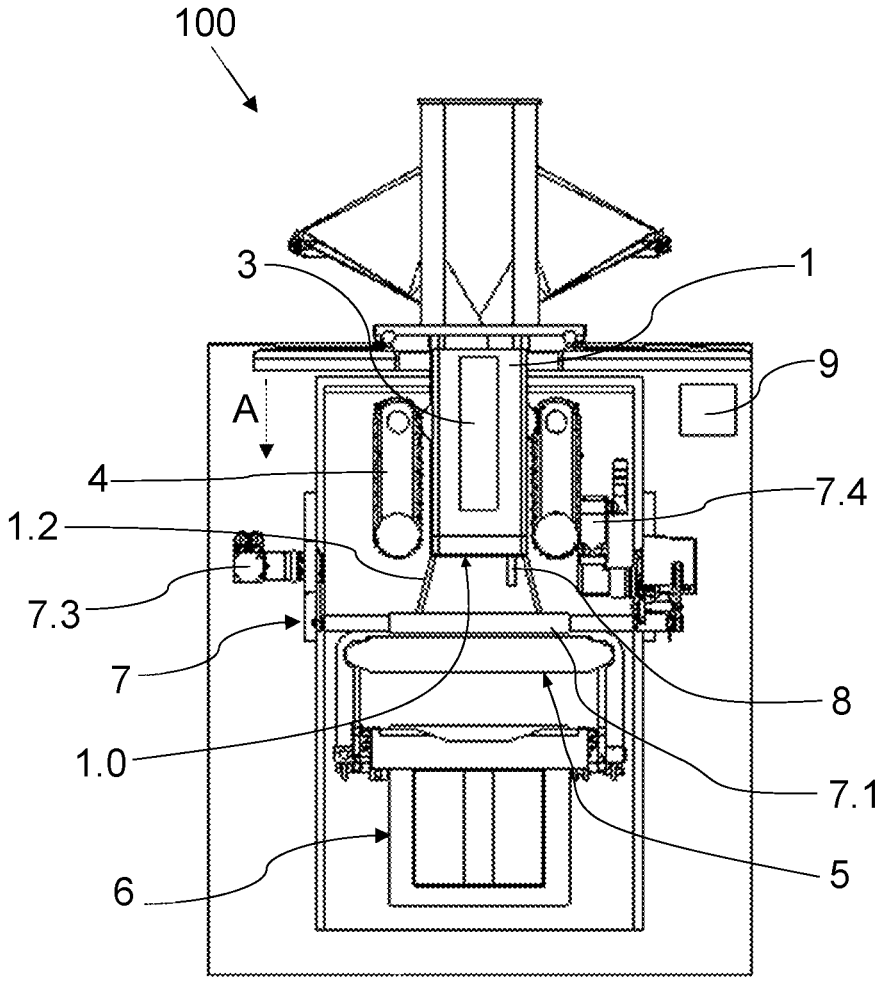
FIG. 1 shows a front view of an embodiment of a vertical packaging machine without a protection assembly.
Figure 2:
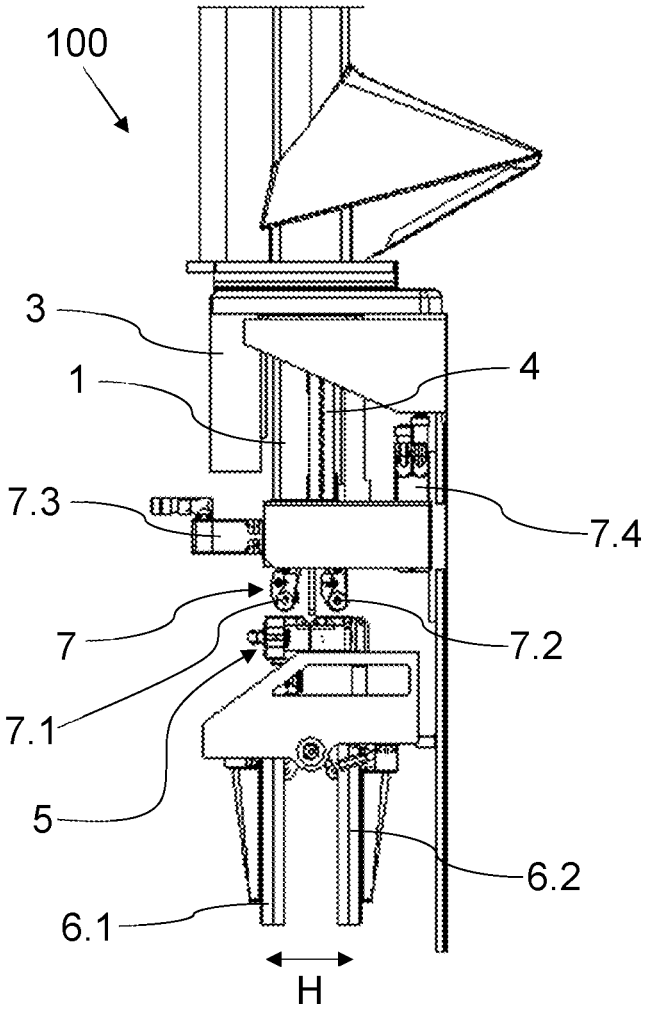
FIG. 2 is a partial side view of the machine of FIG. 1.
Figure 3:
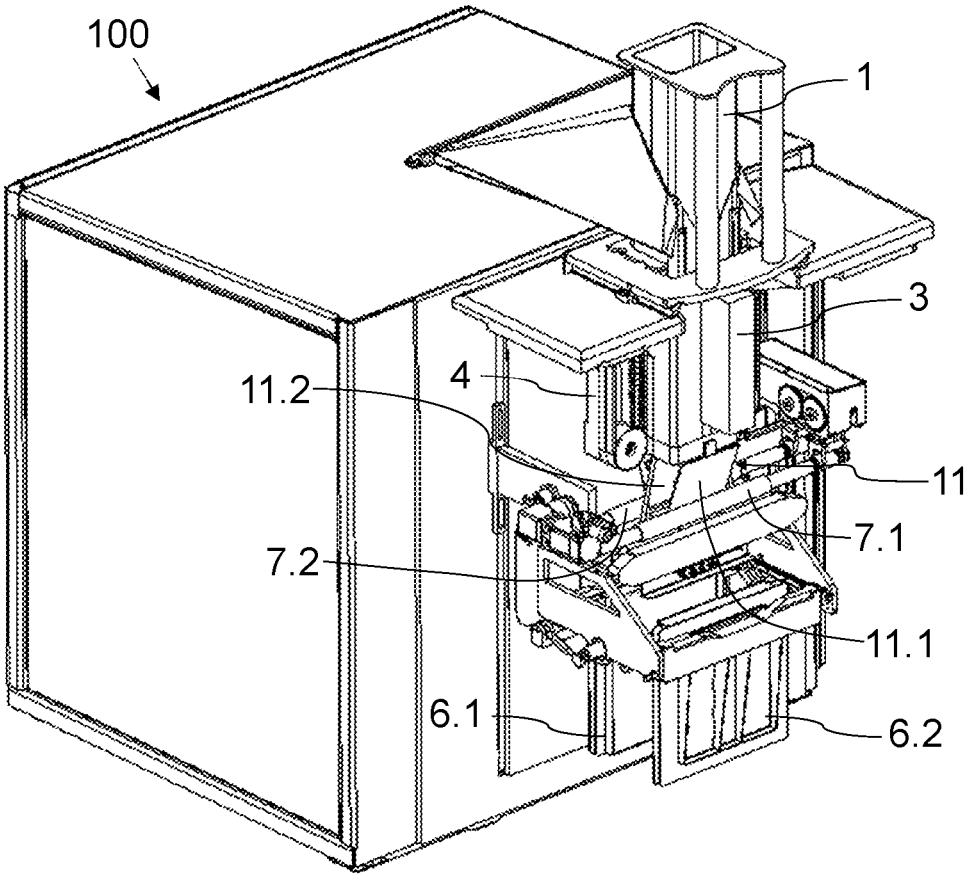
FIG. 3 is a perspective view of the machine of FIG. 1, with the protection assembly.

A first aspect of the invention relates to a packaging machine 100, such as the one depicted by way of example in FIGS. 1 to 3. Said machine 100 comprises a hollow forming tube 1 through which a product P to be packaged is supplied, said forming tube 1 being configured to give a tubular shape to a film and said forming tube 1 comprising an outlet mouth 1.0 with a given outlet width 1.1 in a determined horizontal direction H. The forming tube 1 comprises a longitudinal axis which is preferably vertical (although it could comprise an inclination smaller than 90° with respect to the vertical), and the product P to be packaged falls inside it and exits said forming tube 1 through its outlet mouth 1.0.

The machine 100 further comprises a longitudinal sealing assembly 3 facing the forming tube 1 and configured for longitudinally sealing together two facing ends of the tubular shaped film surrounding the forming tube 1, such that a film tube 200 with said longitudinal seal is generated; and drive means 4 configured to cause said film tube 200 to advance in an advance direction A coincident with, or substantially parallel to, the longitudinal axis of the forming tube 1.

Figure 4A:
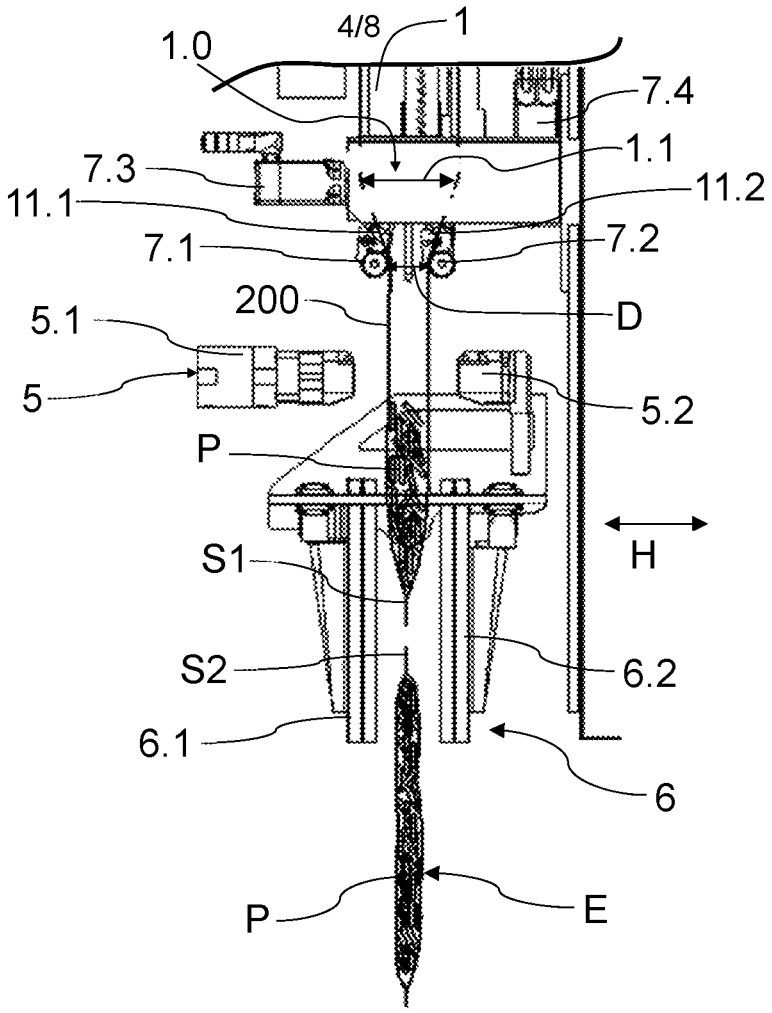
FIG. 4A represents a stage of a packaging carried out on the machine of FIG. 1, where an individual package is identified and where a transverse actuation assembly of said machine is in a first position.
Figure 4B:
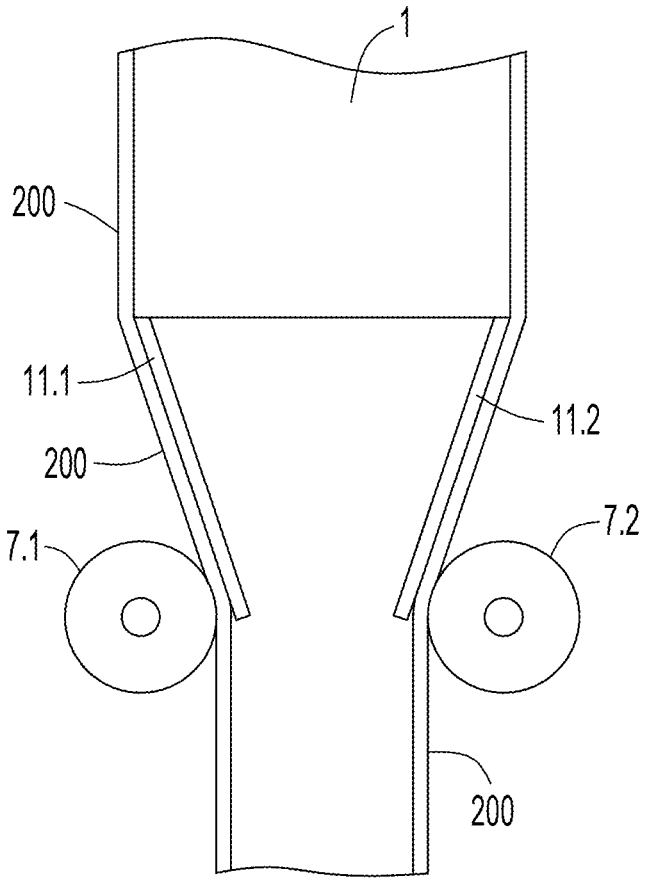
FIG. 4B shows an enlarged view of the vertical packaging machine in the area of the first and second protection elements shows in FIG. 4A.

The machine 100 also comprises a transverse actuation assembly 5 which is arranged downstream of the forming tube 1 and which is configured to transversely seal and cut the film tube 200. The transverse actuation assembly 5 is configured to perform a transverse cut and a transverse seal at each side of the transverse cut (or a single seal with a width greater than the transverse cut such that a first seal S1 is generated upstream of the transverse cut and a second seal S2 is generated downstream of the transverse cut). After the transverse sealing and cutting, as shown in FIG. 4, a package E closed at both ends and with a packaged product P inside is obtained downstream of the transverse actuation assembly 5, and the film tube 200 closed at one end is obtained upstream of the transverse actuation assembly 5.

The transverse actuation assembly 5 comprises two actuation tools 5.1 and 5.2 facing each other in the horizontal direction H, which are configured to move between a first position in which they allow the film tube 200 to pass through them (FIG. 4A) and a second position in which they clamp said film tube 200 together to perform the required transverse cutting and sealing, or required transverse cutting and sealings (FIG. 6), thus a film tube 200 closed at one end and a package E downstream of said transverse cutting being generated. Preferably both actuating tools 5.1 and 5.2 are moved simultaneously and actuated by the same actuator (not shown in the figures) moving towards each other when moving towards the second position or away from each other when moving towards the first position. Alternatively, it could be only one actuating tool 5.1 or 5.2 that moves. Actuating tools 5.1 and 5.2 move in the horizontal direction H.

The machine 100 may further comprise extenders 1.2 attached to the forming tube 1 protruding from the outlet 1.0 of the forming tube 1 in the direction of the transverse actuation assembly 5. The extenders 1.2 stretch the film tube 200 from the inside of said film tube 200 in a transverse direction to the displacement of the actuating tools 5.1 and 5.2 of the transverse actuation assembly 5, thus stretching the film tube 200 in such a way as to facilitate a homogeneous distribution of the product P in a transverse direction to the outlet width 1.1 of the outlet 1.0 of the forming tube 1, and additionally avoiding the appearance of wrinkles in the area of said film tube 200 where said transverse actuation assembly 5 acts.

The machine 100 further comprises extraction means 8 configured to extract a gas from the film tube 200, such that the volume of the final package E generated can thereby be reduced; and a compacting assembly 6 which is arranged downstream of the transverse actuation assembly 5 and which is configured to move in the horizontal direction H to compact the product P.

The extraction means can be of any known type, such as a lance passing through the forming tube 1 and through which a suction is generated (see FIG. 1), extraction means combined with a coaxial forming tube 1 (not shown in the figures), or the extraction means 8 integrated in the transverse actuation assembly 5 (not shown in the figures) for example.

Figure 5A:
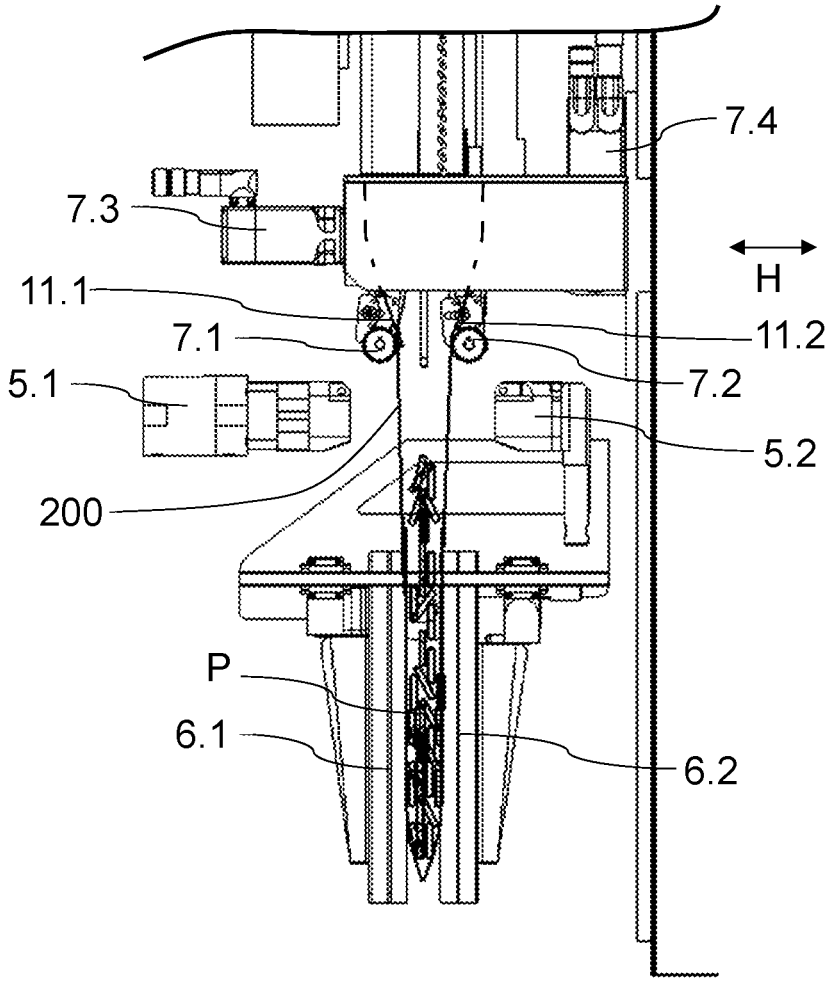
FIG. 5A shows another stage of packaging carried out in the machine of FIG. 1, where a compacting assembly of this machine is identified compacting a product.
Figure 5B:
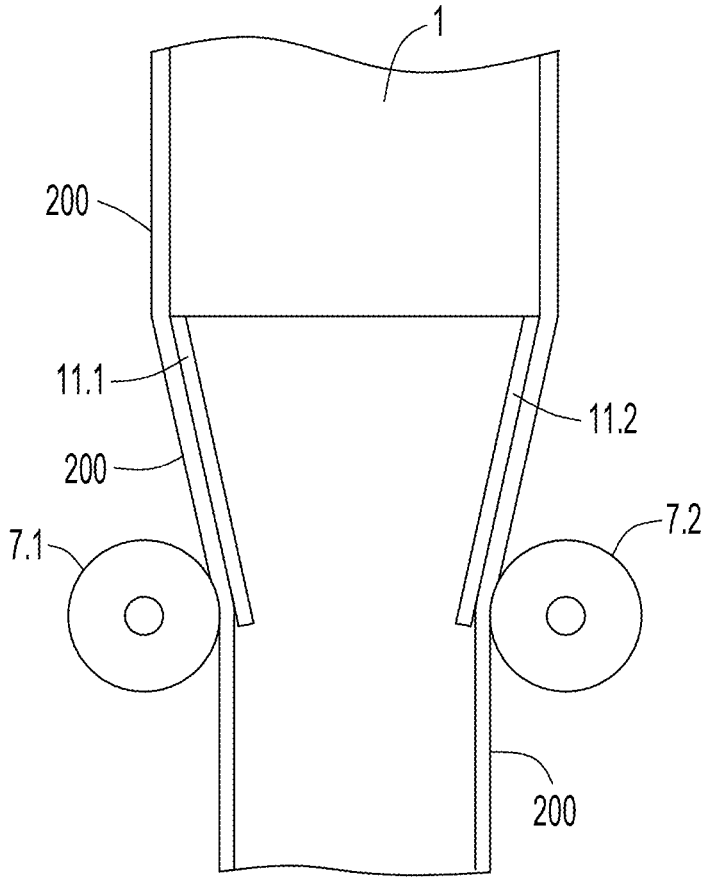
FIG. 5B shows an enlarged view of the vertical packaging machine in the area of the first and second protection elements shows in FIG. 5A.
Figure 6:
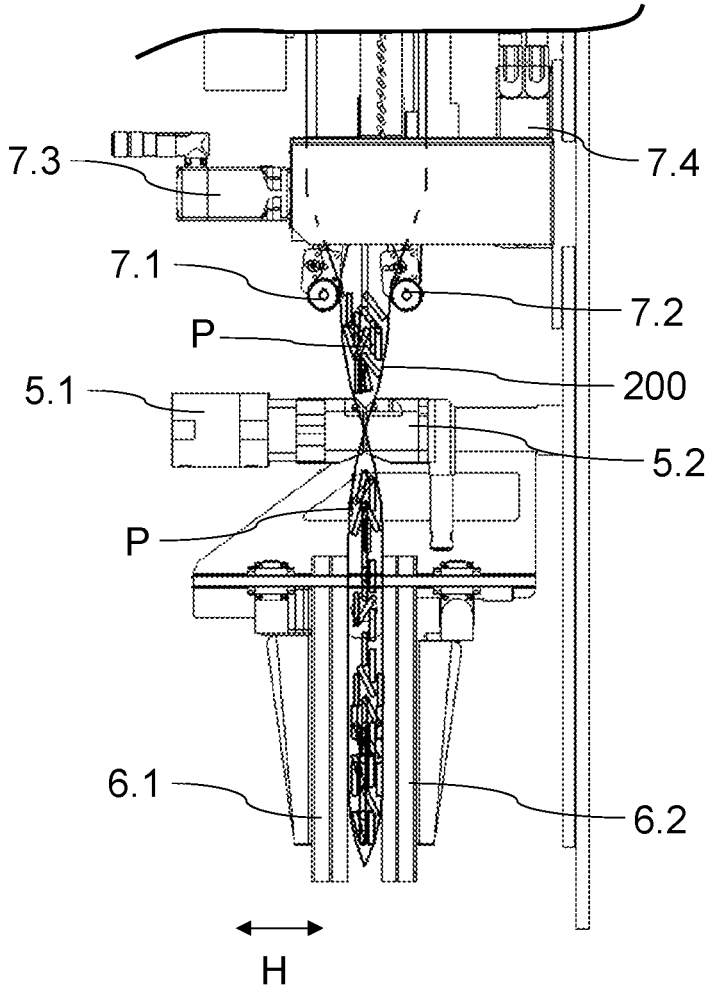
FIG. 6 shows another stage of the packaging carried out on the machine of FIG. 1, with the transverse actuation assembly of the machine in a second position.

The compacting assembly 6 comprises two compacting tools 6.1 and 6.2 facing each other in the horizontal direction H and configured to move in said horizontal direction H between a first position in which they are arranged a predetermined first distance apart (see FIG. 4A), and a second position in which they are arranged a predetermined second distance apart smaller than the predetermined first distance and smaller than the outlet width 1.1 of the outlet 1.0 of the forming tube 1, compacting the product P (FIGS. 5A and 6). Preferably, the first distance is smaller than the outlet width 1.1 of the outlet 1.0 of the forming tube 1. In some embodiments, each compacting tool 6.1 and 6.2 is attached to a respective actuation tool 5.1 and 5.2 of the transverse actuation assembly 5, such that each compacting tool 6.1 and 6.2 moves together with the actuation tool 5.1 to which it is attached during a change of position.

The compacting assembly 6 may additionally comprise respective rollers (not shown) associated with each compacting tool 6.1 and 6.2, and said rollers may be synchronised with the driving means 4 so that a tangential component T in the advance direction A of the rotational speed of said rollers is equal to the advancing speed of the film tube 200 in said advance direction A. For this purpose, the compacting assembly 6 comprises at least one actuator not shown in the figures for causing such rotation. A control unit 9 of the machine 100 would be in communication with said actuator and would be configured to synchronise the actuation of said actuator with the driving means 4. In this way said rollers follow the advance of the film tube 200 and do not negatively influence said advance.

The machine 100 further comprises a distribution assembly 7 which is arranged downstream of the outlet 1.0 of the forming tube 1, and outside the film tube 200, which is configured to modify the distribution of the product P inside the film tube 200 in use, and which comprises a first distribution element 7.1 and a second distribution element 7.2 facing each other in the horizontal direction H between which the film tube 200 passes. In use, the distribution elements 7.1 and 7.2 are spaced apart from each other in said horizontal direction H by a separation distance D which is smaller than the outlet width 1.1 of the outlet 1.0 of the forming tube 1, but which allows the passage of the film tube 200 and the product P, as shown in FIG. 4A. At least the first distribution element 7.1 is a rotatory element (a wheel or a roller for example), and is arranged in such a way that, in use, said first element 7.1 presses the film tube 200 inwards (towards the second distribution element 7.2), from the outside. Preferably the second distribution element 7.2 is also a rotatory element (a wheel or a roller for example), and is arranged in such a way that, in use, said second distribution element 7.2 presses the film tube 200 inwards (towards the first distribution element 7.1), from the outside.

The rotatory element comprises an outer surface that is in contact with the film tube 200, and said surface is made of a specific material so as not to damage the film tube 200 or comprises a layer of said material. Such material may be a sponge material, for example.

The distribution assembly 7 comprises an actuator 7.3 configured to cause the rotatory element to rotate, and said rotation is synchronized with the drive means 4 so that a tangential component T in the advance direction A of the rotational speed of said rotatory element is equal to the feed rate of the film tube 200. In this way said rotatory element follows the feed rate of the film tube 200 and does not negatively influence the feed rate of the film tube 200. The machine 100 comprises a drive actuator 40 configured to cause actuation of the driving means 4 on the reed tube 200, and the control unit 9 is communicated with the drive actuator 40 and with the actuator 7.3 and is configured to synchronise the actuations of said drive actuator 40 and said actuator 7.3.

The distribution assembly 7 comprises an actuator 7.4 associated with at least one of the distribution elements 7.1 and 7.2 of said distribution assembly 7, said actuator 7.4 being configured to move said distribution element 7.1 or 7.2 associated in the horizontal direction H to adjust the separation distance D between the two distribution elements 7.1 and 7.2. Preferably said actuator 7.4 is associated with both distribution elements 7.1 and 7.2, displacing said two distribution elements 7.1 and 7.2 simultaneously (moving them closer together to decrease the separation distance D or moving them further apart to increase said separation distance D).

In the machine 100, an initial adjustment of the separation distance D is made before the start of the packaging of products P, whereby the two distribution elements 7.1 and 7.2 are arranged at an optimum separation distance D, which depends on the outlet width 1.1 of the outlet 1.0 of the forming tube 1 and the type of product P to be packaged for example. In use, i.e., during the packaging of products P, the actuator 7.4 can furthermore generate vibration-like movements of the distribution assembly 7 by slightly modifying the separation distance D, in order to help the product P to be distributed and to avoid jamming in the advancement of the film tube 200 with the product P inside it.

In embodiments in which the compacting assembly 6 is not attached to the transverse actuation assembly 5, said compacting assembly 6 further comprises an actuator not shown in the figures, for causing a movement of the compacting tools 6.1 and 6.2 in the horizontal direction H. Said actuator causes said compacting tools 6.1 and 6.2 to move towards each other to compact the product P (closing movement) and away from each other once they have compacted it (opening movement). Said actuator is thus communicated to and controlled by the control unit 9, which may furthermore be configured to arrange the compacting assembly 6 in the second position, and to cause a closing and opening movement by way of vibration of the compacting tools 6.1 and 6.2, with the compacting tools 6.1 and 6.2 in said second position, to prevent the film tube 200 with the product P inside it from getting stuck at the entrance of the compacting assembly 6.

In some of these embodiments, the distribution assembly 7 is arranged downstream of the transverse actuation assembly 5, each of the distribution elements 7.1 and 7.2 of the distribution assembly 7 being associated with a respective compacting tool 6.1 and 6.2 of the compacting assembly 6, moving together with the associated compacting tool 6.1 and 6.2. Said distribution elements 7.1 and 7.2 are arranged in the area further upstream of said compacting tools 6.1 and 6.2, or upstream of said compacting tools 6.1 and 6.2, in such a way as to act on the product P before said product P is compacted by said compacting tools 6.1 and 6.2.

In other embodiments not shown in the figures, in the machine 100 the distribution assembly 7 is arranged between the transverse actuation assembly 5 and the compacting assembly 6, so that also in this case it is ensured that the product is more homogeneously distributed before the actuation of the compacting assembly 6. In addition, this allows the product P to acquire a higher speed during its fall, so that the risk of the product jamming when passing between the actuation tools 5.1 and 5.2 is reduced.

Preferably, in the machine 100 the distribution assembly 7 is arranged between the outlet 1.0 of the forming tube 1 and the transverse actuation assembly 5 (as shown in the figures), in order to take advantage of the falling speed of the product P and thus make it possible to further reduce the separation distance D between the distribution elements 7.1 and 7.2. This avoids or reduces the risk of the product jamming when passing between the distribution elements 7.1 and 7.2, while also making it possible to further reduce the first predetermined separation distance between the compacting tools 6.1 and 6.2.

In the embodiments wherein the distribution assembly 7 is arranged between the outlet 1.0 of the forming tube 1 and the transverse actuation assembly 5, the machine 100 may further comprise a protection assembly 11 disposed at least partially between the forming tube 1 and the transverse actuation assembly 5, which is attached to said forming tube 1 such that the film tube 200 surrounds said protection assembly 11, and which, in an operational position, allows the product P to pass through it from the forming tube 1 into the transverse actuation assembly 5 but interferes with its path. By such interference it slows down or slows down the fall of the product P, thereby decreasing the risk of the film tube 200 rupturing. The protection assembly 11 comprises a first protection element 11.1 and a second protection element 11.2 facing each other between which the product P passes. The distribution assembly 7 is arranged in such a way that it presses against said protection assembly 11 keeping it in the operative position during packaging.

The distribution assembly 7 of any of the embodiments of the machine 100 allows the compaction tools 6.1 and 6.2 to be arranged separately in the first position at a first distance smaller than the outlet width 1.1 of the outlet mouth 1.0 of the forming tube 1, and thus reduce the time necessary to compact the product P when moving the compacting assembly 6 from the first position to the second position, as a less displacement between the first and second position is required.

A second aspect of the invention relates to a method for a packaging machine 100 such as the one of the first aspect of the invention in any of its configurations and/or embodiments. The method will be adapted to the corresponding configuration and/or embodiment of the machine 100. What is described for the machine 100 is thus also applicable to the method, although not explicitly included.

The method comprises arranging a film around the forming tube 1; sealing together two longitudinal ends of the film arranged around the forming tube 1 by means of the longitudinal sealing assembly 3, a film tube 200 being generated; causing said film tube 200 to advance by means of the driving means 4 in an advance direction A; transverse sealing and cutting said film tube 200 downstream of the forming tube 1, by means of the transverse actuation assembly 5 as previously described, a closed film tube 200 being generated upstream of the cut and a package E being generated downstream of the cut; and supplying a product P to be packaged into the film tube 200, through the interior of the forming tube 1. This product P falls through the forming tube 1 and the film tube 200, towards the closed end of the film tube 200. As the film tube 200 advances, this product P will form part of the package E generated in the subsequent sealing and cutting operation of the transverse actuation assembly 5.

The method further comprises compacting the product P disposed inside the film tube 200 downstream of the transverse actuation assembly 5, by means of the compacting assembly 6; and extracting a gas from the film tube 200 by means of the extraction means 8 at least after compacting the product P, thereby reducing the volume of the package E as described above.

The method further comprises, before compacting the product P by means of the compacting assembly 6, modifying the distribution of the product P downstream the outlet 1.0 of the forming tube 1 by means of a distribution assembly 7 as the one described before. How this modification is carried out and the elements involved in it have already been described previously for the first aspect of the invention and are not reproduced again.

As also previously described, in order to make the modification of the distribution more effective, successive or intermittent changes of the separation distance D between the first distribution element 7.1 and the second distribution element 7.2 can be applied, as a vibration, during the actuation of the distribution assembly 7 on the product P.

Preferably the distribution elements 7.1 and 7.2 press a part of the film tube 200 arranged between the forming tube 1 and the transverse actuation assembly 5. In these cases, the method may further comprise a protection assembly 11 as previously described for, in an operational position, allowing the passage through of the product P from the forming tube 1 towards the transversal actuation assembly 5 but interfering in its path, in such a way that with said interference the fall of the product P is stopped or slowed down, reducing the risk of the film tube 200 breaking.

In other embodiments, the distribution elements 7.1 and 7.2 press a portion of the film tube 200 that is downstream of the transverse actuation assembly 5. The distribution elements 7.1 and 7.2 may be upstream of the compacting assembly 6 or in the most upstream area of said compacting assembly 6, as has also been previously described.

Embodiments are recited in the following clauses.

Clause 1. Vertical packaging machine comprising a hollow forming tube (1) through which a product (P) to be packaged is supplied, the forming tube (1) being configured to give a tubular shape to a film and comprising an outlet (1.0) with a given outlet width (1.1) in a given horizontal direction (H); a longitudinal sealing assembly (3) configured to longitudinally seal together two facing ends of the tubular shaped film and to generate a film tube (200) with such longitudinal sealing; and a transverse actuation assembly (5) which is arranged downstream of the forming tube (1) and comprises two actuation tools (5.1, 5.2) facing each other and configured to move in the horizontal direction (H) between a first position in which they allow the passage of the film tube (200) through them and a second position in which they clamp said film tube (200) together, the machine (100) further comprises a compacting assembly (6) which is arranged downstream of the transverse actuation assembly (5) and which is configured to move in the horizontal direction (H) to compact the product (P) to be packaged; extraction means (8) configured to extract gas from the film tube (200); and a distribution assembly (7) which is arranged downstream the outlet port (1.0) of the forming tube (1), and outside the film tube (200), and which in use is configured to modify the distribution of the product (P) inside the film tube (200), the distribution assembly (7) comprising a first distribution element (7.1) and a second distribution element (7.2) facing each other in the horizontal direction (H) and which in use are spaced from each other in said horizontal direction (H) by a separation distance (D) which is smaller than the outlet width (1.1) of the outlet (1.0) of the forming tube (1) and which allows the product (P) to pass through, at least the first distribution element (7.1) being a rotatory element.

Clause 2. Vertical packaging machine according to clause 1, comprising driving means (4) configured to cause the advancement of said film tube (200) in an advance direction (A), the rotation of the rotatory element of the distribution assembly (7) being synchronised with the driving means (4) so that a tangential component (T) in the advance direction (A) of the turning speed of said rotatory element is equal to the advancing speed of the film tube (200)

Clause 3. Vertical packaging machine according to clause 2, wherein the distribution assembly (7) comprises an actuator (7.3) configured to cause the rotatory element of said distribution assembly (7) to rotate, the machine (100) comprising a drive actuator (40) configured to cause the drive means (4) to act on the film tube (200), and a control unit (9) communicated with the drive actuator (40) and said actuator (7.3) configured to cause the rotatory element to rotate and configured for synchronising the actions of said drive actuator (40) and said actuator (7.3) configured to cause the rotatory element to rotate.

Clause 4. Vertical packaging machine according to any of clauses 1 to 3, wherein the second distribution element (7.2) of the distribution assembly (7) is a rotatory element and is arranged such that, in use, said rotatory element presses against the outside of the film tube (200).

Clause 5. Vertical packaging machine according to any of clauses 1 to 4, wherein the distribution assembly (7) comprises an actuator (7.4) associated with at least one of the distribution elements (7.1, 7.2) of said distribution assembly (7), said actuator (7.4) being configured to move said associated distribution element (7.1, 7.2) in the horizontal direction (H) to adjust the separation distance (D) between the two distribution elements (7.1, 7.2).

Clause 6. Vertical packaging machine according to clause 5, wherein the actuator (7.4) is configured to move both distribution elements (7.1, 7.2) simultaneously.

Clause 7. Vertical packaging machine according to any of clauses 1 to 6, wherein the compacting assembly (6) comprises two compacting tools (6.1, 6.2) facing each other and configured to move in the horizontal direction (H) between a first position in which they are arranged a first predetermined distance apart, and a second position in which they are arranged a second predetermined distance apart, said second predetermined distance being smaller than the first predetermined distance and smaller than the outlet width (1.1) of the outlet (1.0) of the forming tube (1), the first predetermined distance being preferably smaller than the outlet width (1.1) of the outlet (1.0) of the forming tube (1).

Clause 8. Vertical packaging machine according to clause 7, wherein each of the distribution elements (7.1, 7.2) of the distribution assembly (7) is associated with a respective compacting tool (6.1, 6.2) of the compacting assembly (6), said distribution elements (7.1, 7.2) being arranged in the most upstream area of said compacting tools (6.1, 6.2) or upstream of said compacting tools (6.1, 6.2).

Clause 9. Vertical packaging machine according to any of clauses 1 to 7, wherein the distribution assembly (7) is arranged between the outlet (1.0) of the forming tube (1) and the transverse actuation assembly (5).

Clause 10. Vertical packaging machine according to clause 9, comprising a protection assembly (11) arranged at least partially between the forming tube (1) and the transverse actuation assembly (5), which is attached to said forming tube (1) such that the film tube surrounds said protection assembly (11), which in an operational position allows the product (P) to pass through it from the forming tube (1) towards the transverse actuation assembly (5) but interferes with its path, said protection assembly (11) comprising a first protection element (11.1) and a second protection element (11.2) facing each other between which the product (P) passes, the distribution assembly (7) being so arranged that, in use, it presses against said protection assembly (11) holding it in the operating position.

Clause 11. Vertical packaging machine according to any one of clauses 1 to 7, wherein the distribution assembly (7) is arranged between the transverse actuation assembly (5) and the compacting assembly (6).

Clause 12. Method for a vertical packaging machine, the method comprising arranging a film around a forming tube (1) comprising an outlet (1.0) with a given outlet width (1.1) in a given horizontal direction (H); sealing together two longitudinal ends of the film arranged around the forming tube (1) by means of a longitudinal sealing assembly (3), a film tube (200) being generated; supplying a product (P) to be packaged into the film tube (200), through the inside of the forming tube (1); and transversely sealing and cutting said film tube (200) downstream of the forming tube (1), by means of a transverse actuation assembly (5); characterised in that the method further comprises compacting the product (P) inside the film tube (200) downstream of the transverse actuation assembly (5) by a compacting assembly (6), extracting a gas from the film tube (200) at least after compacting the product (P) with extraction means (8); and before compacting the product (P) by the compacting assembly (6), pressing inwards, from the outside of said film tube (200), a part of the film tube (200) downstream of the outlet (1.0) of the forming tube (1) by means of a first distribution element (7.1), which is a rotatory element, and a second distribution element (7.2) of a distribution assembly (7) between which the said film tube (200) advances, in order to modify the distribution of the product (P) passing through the said distribution elements (7.1, 7.2) and through the interior of the film tube (200), said distribution elements (7.1, 7.2) facing each other in the horizontal direction (H) and being spaced from each other in said horizontal direction (H) by a separation distance (D) smaller than the outlet width (1.1) of the outlet (1.0) of the forming tube (1).

Clause 13. Method according to clause 12, wherein successive or intermittent changes of the separation distance (D) are applied between the first distribution element (7.1) and a second distribution element (7.2), at least when the distribution assembly (7) is acting on the product (P).

Clause 14. Method according to clause 12 or 13, wherein the distribution elements (7.1, 7.2) press a part of the film tube (200) arranged between the forming tube (1) and the transverse actuation assembly (5).

Clause 15. Method according to clause 12 or 13, wherein the distribution elements (7.1, 7.2) press a part of the film tube (200) arranged downstream of the transverse actuation assembly (5).

The invention claimed is:

1. A vertical packaging machine comprising:

a hollow forming tube through which a product to be packaged is supplied, the forming tube being configured to give a tubular shape to a film, the hollow forming tube including an outlet with an outlet width in a horizontal direction;

a longitudinal sealing assembly configured to longitudinally seal together two facing ends of the tubular shaped film and to generate a film tube;

a transverse actuation assembly arranged downstream of the forming tube and including two actuation tools facing each other and configured to move in the horizontal direction between a first position in which they allow the passage of the film tube through them and a second position in which they clamp opposite sides of the film tube together;

a compacting assembly arranged downstream of the transverse actuation assembly and that is configured to move in the horizontal direction to compact the product in the film tube;

an extraction assembly distinct and separate from the compacting assembly that is configured to extract gas from the film tube;

a distribution assembly arranged downstream of the outlet port of the forming tube and outside the film tube, and which in use is configured to modify the distribution of the product inside the film tube, the distribution assembly including a first distribution element and a second distribution element facing each other in the horizontal direction and which are continuously spaced from each other in the horizontal direction by a separation distance which is smaller than the outlet width of the outlet of the forming tube and which allows the product to pass through, the first distribution element comprising a first rotatory element that is configured to press against an outside of the film tube wherein the distribution assembly is arranged between the outlet of the forming tube and the transverse actuation assembly; and the vertical packaging machine further comprising a protection assembly arranged at least partially between the forming tube and the transverse actuation assembly, the protection assembly being attached to the forming tube such that the film tube surrounds the protection assembly, in an operational position the protection assembly allows the product to pass through it from the forming tube towards the transverse actuation assembly but interferes with the product path, the protection assembly comprising a first protection element and a second protection element facing each other and between which the product passes, in use the distribution assembly is arranged to press against the protection assembly to hold it in the operational position.

2. The vertical packaging machine according to claim 1, comprising a drive configured to cause an advancement of the film tube in an advance direction at an advancing speed, a rotation of the first rotatory element being synchronized with the drive so that a tangential component in the advance direction of a turning speed of the first rotatory element is equal to the advancing speed of the film tube.

3. The vertical packaging machine according to claim 2, wherein the distribution assembly comprises a first actuator that is configured to cause the first rotatory element to rotate, the vertical packaging machine comprising a drive actuator that is configured to cause the drive to act on the film tube, and a control unit communicated with the drive actuator, the first actuator being configured to cause the first rotatory element to rotate and also being configured to synchronize actions of itself with actions of the drive actuator.

4. The vertical packaging machine according to claim 3, wherein the distribution assembly comprises a second actuator that is configured to move at least one of the first and second distribution elements in the horizontal direction to adjust the separation distance between the first and second distribution elements.

5. The vertical packaging machine according to claim 4, wherein the second actuator is configured to simultaneously move the first and second distribution elements in respective first and second directions in the horizontal direction, the first and second directions being opposite one another.

6. The vertical packaging machine according to claim 1, wherein the second distribution element comprises a second rotatory element that is configured to press against the outside of the film tube.

7. The vertical packaging machine according to claim 1, wherein the compacting assembly comprises first and second compacting tools facing each other and configured to move in respective first and second directions opposite one another in the horizontal direction between a first position in which they are arranged a first distance apart, and a second position in which they are arranged a second distance apart, the second distance being smaller than the first distance and smaller than the outlet width of the outlet of the forming tube, the first distance being smaller than the outlet width of the outlet of the forming tube.

8. The vertical packaging machine according to claim 7, wherein the first and second said distribution elements are respectively upstream of the first and second compacting tools.

9. The vertical packaging machine according to claim 7, wherein the extraction assembly is configured to extract gas from the film tube after the first and second compacting tools have assumed the second distance apart.

10. The vertical packaging machine according to claim 1, wherein the extraction assembly is configured to extract gas from the film tube after the compacting assembly has moved in the horizontal direction to compact the product in the film tube.

11. The vertical packaging machine according to claim 1, wherein the extraction assembly is located at or near the outlet of the forming tube.

12. The vertical packaging machine according to claim 1, further comprising an extender attached to and protruding from the forming tube, the extender being configured to stretch the film tube from the inside of the film tube, at least a portion of the extraction assembly being located inside a perimeter formed by the extender.

* * * * *